United States Patent [19]

St. Denis

[11] 4,083,551

[45] Apr. 11, 1978

[54] METHOD AND APPARATUS FOR ON-LINE TIPPING OF INSERTS

[75] Inventor: Robert A. St. Denis, Gaithersburg, Md.

[73] Assignee: Harris Corporation, Cleveland, Ohio

[21] Appl. No.: 728,431

[22] Filed: Sep. 30, 1976

[51] Int. Cl.[2] ..... B65H 5/30

[52] U.S. Cl. ..... 270/55; 270/53; 270/57

[58] Field of Search ..... 270/37, 53, 54, 58, 270/55, 57; 156/566, 568, 570

[56] References Cited

U.S. PATENT DOCUMENTS

| | | | |
|---|---|---|---|
| 3,404,880 | 10/1968 | Porter | 270/53 |
| 3,630,513 | 12/1971 | Davidson | 270/53 |
| 3,658,318 | 4/1972 | Bunting | 270/55 |
| 3,663,007 | 5/1972 | Preiter | 270/55 |
| 3,826,706 | 7/1974 | Muller | 156/566 |

*Primary Examiner*—Edgar S. Burr
*Assistant Examiner*—A. Heinz

[57] ABSTRACT

A method and apparatus for tipping an insert onto a signature being moved by the main conveyor of a collating system. An insert is removed from a standard hopper of the collating system and is directed into a position to be moved by an auxiliary conveyor in timed relationship to the movement of a signature by the main conveyor. The auxiliary conveyor moves the insert in a proper spaced relationship to the signature being moved by the main conveyor. As the signature is moved past an adhesive applying station, adhesive is applied to the signature and the auxiliary conveyor then brings the insert into juxtaposition with the moving signature. According to the preferred embodiment, pressure is applied to the signature and insert shortly after they are brought into juxtaposition with each other to promote adherence of the insert to the signature.

8 Claims, 5 Drawing Figures

METHOD AND APPARATUS FOR ON-LINE TIPPING OF INSERTS

BACKGROUND OF THE INVENTION

This application relates generally to a method and apparatus for tipping inserts onto signatures being moved by the main conveyor of a collating system. It relates particularly to a method and apparatus in which both the signatures and the inserts are fed from standard hoppers which are all disposed on-line, on one side of a conventional saddle gatherer.

Automated systems for assembling articles such as books or magazines typically include a system which collates signatures from different sources. One well accepted type of system for collating signatures is generally referred to as a saddle gatherer. A saddle gatherer includes a saddle associated with each of a series of hoppers. Each saddle has at least a portion which is formed in a generally inverted-V shape for receiving partially opened signatures from its associated hopper and for maintaining the signatures in a partially opened condition.

A saddle conveyor includes several signature engaging portions which are moved in succession past the saddles to engage the signature and push the signatures therefrom. All of the hoppers are generally disposed on-line adjacent one side of the saddle conveyor (referred to hereinafter as the "feeder" side of the saddle conveyor). As a signature is picked from a saddle by a signature engaging portion of the saddle conveyor the signature is deposited on top of other signatures being moved by that signature engaging portion for movement therewith. As the system is operated signatures are continually hand loaded into the hoppers by a person often referred to as a "feeder" who is positioned on the feeder side of the saddle conveyor.

There have also been various systems disclosed which relate to the feeding of inserts with respect to the collated signatures. Some of these systems are adapted to adhesively secure inserts to one or more of the collated signatures. These systems are commonly referred to as tipping systems. One type of known tipping system is illustrated in U.S. Pat. No. 3,371,924. This patent discloses a tipping system in which a special insert feeding unit is combined with a selected signature hopper. The insert feeding unit is designed to apply a layer of adhesive to an insert and to combine the insert with a signature which has been removed from the selected hopper before the signature is opened and deposited onto a saddle conveyor.

Another type of tipping system has been disclosed in which a special insert hopper is provided, and adhesive is applied to the insert after it is withdrawn from the hopper and before it is combined with a signature being moved by a saddle conveyor. The insert hopper is disposed on the operator's side of the saddle conveyor and is not a standard hopper of a conventional saddle gatherer. A patent disclosure apparently related to such a system can be found in U.S. Pat. No. 3,826,706.

Another related type of system, though not specifically directed to tipping of inserts, is disclosed in U.S. Pat. No. 3,663,007. In this disclosure inserts are fed from a hopper onto a special rail and are moved by the saddle conveyor along with the collected signatures. The device provides for moving the insert relative to the signature prior to the trimming and binding station to avoid the insert being trimmed at the trimming and binding station. This patent does not relate to the adhesively securing of an insert to collated signatures.

Still other disclosures relating to automated handling of signatures can be found in U.S. Pat. No. 3,311,368, 3,414,257, 3,481,594, 3,545,740, 3,658,318, and 3,880,418.

SUMMARY OF THE INVENTION

The present invention relates to a method and apparatus for tipping an insert onto a moving signature, and particularly to a method and apparatus in which inserts are fed from a standard hopper of a conventional saddle gatherer. According to the basic principles of the invention an insert is fed from a hopper and is directed into position for engagement with an insert moving portion of an auxiliary conveyor which is moving in timed relationship to the movement of a signature engaging portion of a main conveyor. The auxiliary conveyor is designed so that the insert is moved in a proper spaced relationship to the signature as the signature is moved past an adhesive applying station where adhesive is applied thereto. The insert is then brought into juxtaposition with the moving structure so that the insert contacts the adhesive and is firmly held against the signature. According to the preferred embodiment, pressure is applied to the signature and insert shortly after they are brought into juxtaposition with each other to promote firm adherence of the insert to the signature.

The present invention provides a particularly advantageous method and apparatus for tipping an insert onto any one of a set of signatures which are collated on a conventional saddle gatherer. Inserts are provided in one of the standard hoppers of the gatherer so that the hopper is readily accessible from the feeder side of the conveyor. The inserts are directed from the hopper into position to be engaged by an insert moving portion of an auxiliary conveyor which is disposed on the operator's side of the saddle conveyor. The auxiliary conveyor is designed so that the insert is moved in proper spaced and timed relation to a signature which is being moved by the saddle conveyor and the insert and signature are brought into juxtaposition after adhesive has been applied to the moving signature. Such a system facilitates manual loading of both inserts and signatures because they are both loaded into standard hoppers disposed on the feeder side of the saddle conveyor. Such a system is also extremely versatile in the sense that can be readily modified to orient and secure inserts in various positions relative to the moving signatures.

Further features of the present invention will become further apparent from the following detailed description, taken with reference to the accompanying drawings wherein;

DETAILED DESCRIPTION OF THE PREFERRED EMBODIMENT

Figure 1:
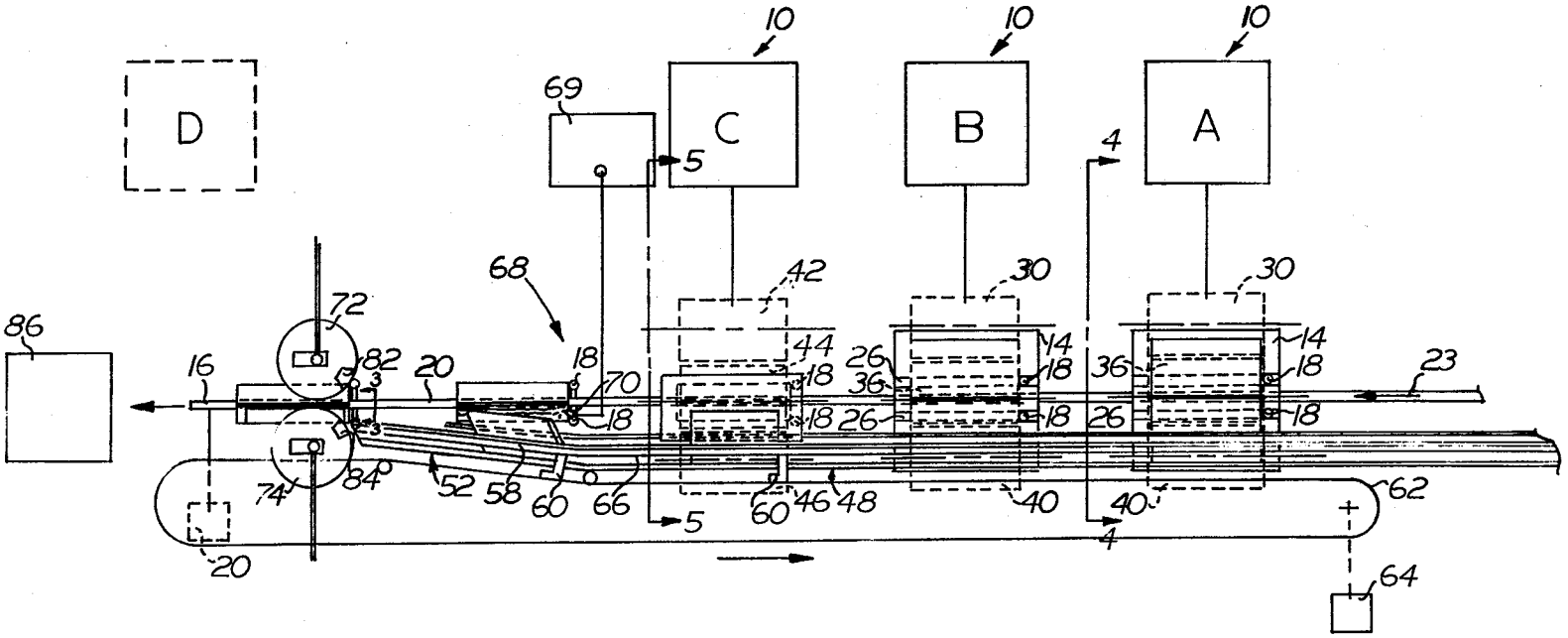
FIG. 1 is a top view of a signature handling system incorporating the principles of the invention which certain portions omitted.
Figure 2:
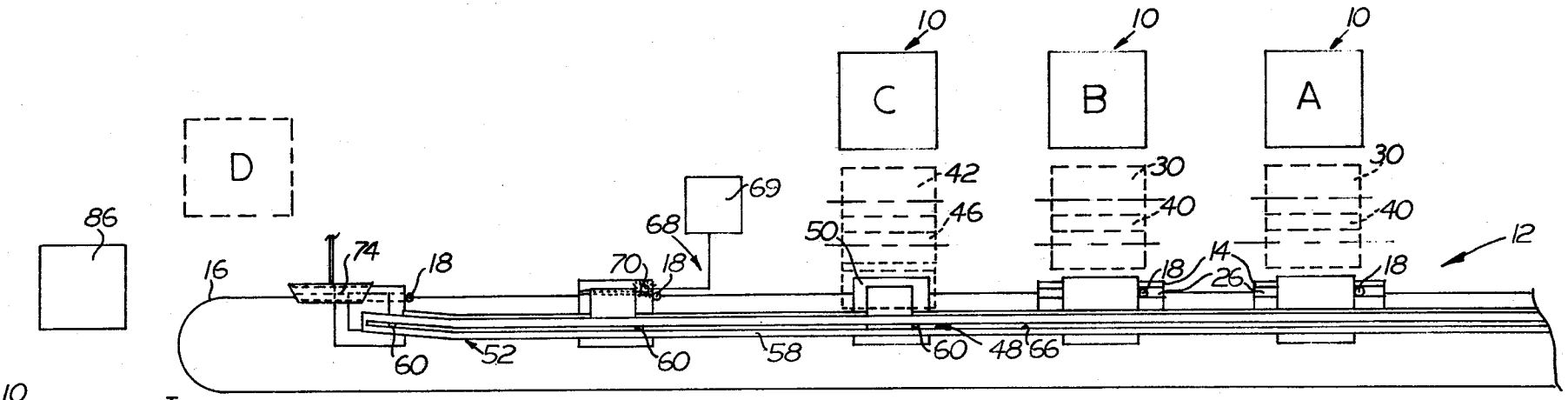
FIG. 2 is a side view of the system of FIG. 1.

FIGS. 1 and 2 schematically illustrate an otherwise conventional saddle gatherer incorporating the principles of the invention. A series of hoppers 10 are disposed in a line adjacent one side of a saddle conveyor 12. The gatherer includes a series of saddles 14 each of which is associated with a respective hopper 10. Each saddle has a generally inverted V shape and is disposed in a fixed positional relationship to its respective hopper 10.

The saddle conveyor 12 includes a conveyor chain 16 carrying a series of pushers 18. The conveyor chain 16 is driven by motor 20 and is disposed below the saddles and moves the pushers 18 successively past the saddles 14. Each pusher is generally Y-shaped, and includes two arms 22, 24 which extend through longitudinal slots 26 in the fixed saddle 14 as the pushers 18 move therepast. Each pusher is thereby effective to strip a signature from a saddle as the pusher moves therepast. The pushers define signature engaging portions which are moved successively past the saddle which is associated with each one of the hoppers 10 (in the direction illustrated by arrow 23).

In the illustrated embodiment there are three hoppers labeled A, B, and C. It is assumed that A and B represent hoppers which are loaded with stacks of signatures and C represents a hopper which is loaded with a stack of inserts. It will be readily apparent to those of ordinary skill in the art that a book or magazine gatherer will normally have many more signature supporting hoppers than the two which are illustrated.

Figure 4:
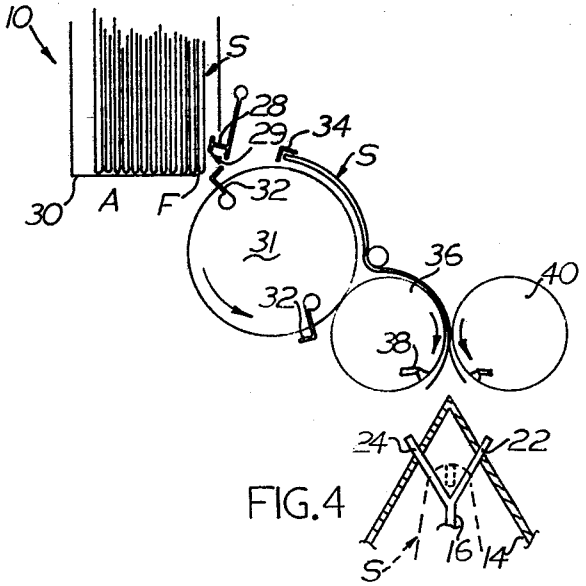
FIG. 4 is a sectional view of the system of FIG. 1, taken from the direction 4—4, and illustrating the feeding of a signature from a hopper onto the saddle conveyor.

In a basic mode of operation, as a pusher 18 approaches the hopper A a signature S is withdrawn from the hopper and is deposited on the associated saddle 14. The basic principles for accomplishing this may be appreciated by reference to FIG. 4. The signatures S are loaded in hopper A in an on-edge condition with their folded edges F lowermost. One or more suction grippers 28 is pivotally mounted with respect to an opening 29 which is formed adjacent the lower surface 30 of the hopper. When a signature is to be removed from the hopper the suction gripper 28 is activated and serves to grip the signature near its lower folded edge and draw the signature through the opening 29 in the hopper.

A rotor drum 31 is disposed adjacent the suction gripper 28. Rotor drum 31 includes a pair of grippers 32 of conventional design which are spaced apart by approximately 180°. The rotor drum 30 rotates continuously counter clockwise (when viewing FIG. 4) and each gripper 32 is adapted to grip a signature which has been withdrawn from the hopper by the suction gripper 28. The rotor drum 31 carries the withdrawn signature to a location adjacent a stop member 34. At this point the gripper 32 operates in a known manner to release the signature and the stop 34 serves to prevent further rotation of the signature with the rotor drum 31.

A transfer drum 36 includes grippers 38 of conventional design which are actuated in timed relation to the movement of the rotor drum 31 and which serve to grip one side of the signature almost immediately after it has been released by rotor drum 31 and engaged stop member 34. Transfer drum 36 rotates in a clockwise direction and draws the signature (with the open end leading) into the nip between the transfer drum 36 and an opener drum 40. The opener drum operates in a known manner in timed relation to the movement of the transfer drum to grip one side of the folded signature S. With the respective sides of the signature gripped between the transfer and opener drums 36, 40, the signature is partially opened. The respective grippers on the transfer and opener drums are deactivated at appropriate points to allow the partially opened signature to drop onto the associated saddle 14. The saddle 14 retains the signature in partially opened condition above the level of the conveyor chain 16. As the pusher member 18 moves past the saddle 14 the pusher member slides the signature along the saddle 14 and off the saddle and the signature then drops onto the chain 16 or onto any previously collected signatures being moved by the pusher member 18.

After picking up the signature which was removed from hopper A, the pusher 18 moves on to the hopper B. As the pusher approaches hopper B a signature is removed from hopper B in the same manner as with hopper A, and is deposited in partially opened position on the associated saddle 14, so that it can be engaged by the moving pusher member 18 and associated with the signature from hopper A.

The foregoing description relates to well known aspects of a typical saddle gatherer. The particular details of the foregoing elements, and of the manner in which those elements are operated in timed relation to each other to deposit signatures from the hoppers onto the saddle conveyor will be readily apparent to those of ordinary skill in the art and therefore requires no further explanation. In addition, if it is desired to control the feeding of signatures from the hoppers in such a manner that certain hoppers periodically or selectively do not feed a signature this would also be accomplished in accordance with the known techniques.

Figure 5:
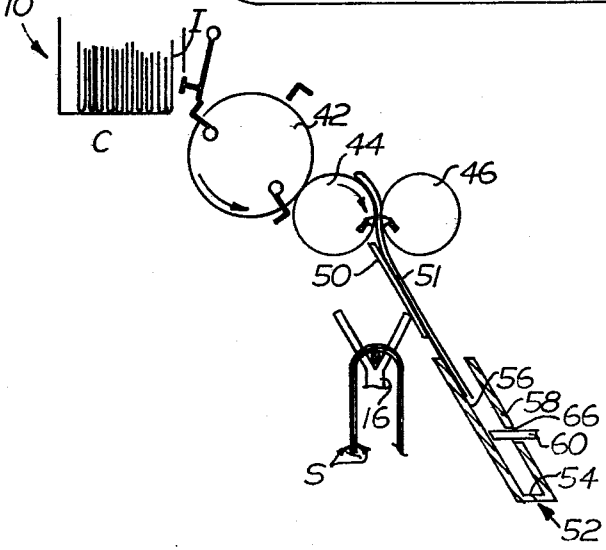
FIG. 5 is a sectional view of the system of FIG. 1, taken from the direction 5—5, and illustrating the feeding of an insert from a hopper onto an auxiliary conveyor in accordance with the invention.

As noted above, one of the standard hoppers, in the illustrated embodiment the hopper C, has a stack of inserts I deposited therein. These inserts may take the form of single sheets, folded sheets (such as illustrated) or any other known type of insert. As seen in FIG. 5 rotor drum 42, transfer drum 44 and opener drum 46 identical to those provided with hoppers A and B are associated with hopper C. The inserts I are disposed on edge in the hopper C, and they are withdrawn from the hopper and transferred to the rotor drum 42 and then to the transfer drum 44 in the same manner that signatures are removed and transferrred from the hoppers A and B.

Once the signature reaches the nip of the transfer drum 44 and the opener drum 46 it is handled in such a manner that it is guided into engagement with a portion of an auxiliary conveyor 48 disposed adjacent the side of the saddle conveyor which the side on which the hoppers are disposed (commonly referred to as the "operator'side" since the operator's controls are generally disposed along that side). A guide member 50 disposed beneath the drums 44, 46 has an inclined surface 51 oriented toward the operator's side of the saddle 14. The mode of operation of the transfer and opener drums is set so that they release the insert in a proper condition to be directed onto the appropriate portions of auxiliary conveyor 48. For example, if the insert I is a single sheet then the opener drum 46 is actuated to grip the sheet in the same manner as it would grip a signature, and the transfer drum 44 is deactivated, so that the sheet is released on the opened drum side of the guide 50. The guide 50 then serves to guide the signature onto the auxiliary conveyor 40. If the insert is a folded signature, then the transfer drum 44 is controlled to release its side of the signature early enough so that the signature is not opened, but is carried by the opener drum 46 and released on the opener drum side of the guide.

The auxiliary conveyor 48 includes a longitudinally extending track 52 disposed adjacent the operator's side of the saddle conveyor. The track 52 preferably includes a flat bottom surface 54 and a pair of inclined side walls 56, 58. A series of pusher members 60 are supported for longitudinal movement by an endless chain 62 which is driven by a motor 64. The pushers 60 extend through a slot 66 formed in the side wall 58 and the pushers are oriented so as to engage any insert I which has been deposited in the track 52. The chain 62 moves each pusher 60 in timed relation to the movement of a respective pusher 18 of the saddle conveyor. The details for controlling such movement will be readily apparent to those of ordinary skill in the art and therefore requires no further detailed explanation.

Each pusher 60 forms an insert engaging portion which moves an insert along a path defined by the track 52. The track 52 is designed so that an insert is moved in spaced relation to a signature or stack of signatures being moved by the saddle conveyor past an adhesive applying station 68. At the adhesive applying station 68 adhesive is applied to the topmost signature being moved by the saddle conveyor. The adhesive is preferably a hot-melt adhesive which is applied by a Nordson hot-melt spray unit having a reservoir 69 located on the feeder side of the saddle conveyor, and a nozzle 70 disposed on the operator's side of the saddle. The application of adhesive is cam controlled in timed relation to the movement of the saddle conveyor. It is contemplated that the adhesive is of a type which allows firm adherence to the signature, but also allows the insert to be forceably detached without leaving a conspicuous adhesive line on the insert.

As seen in FIG. 1, the track 52 is oriented so that the insert is conveyed by the pusher 60 in proper spaced relation to the moving signature until the signature has passed the adhesive applying station 68 where the adhesive has been applied thereto. The track 52 is shaped so that the insert is then directed into juxtaposition with the side of the signature to which the adhesive has been applied at a location just downstream of the adhesive applying station 68. As seen in FIG. 1, the portion of the track disposed downstream of the adhesive applying station 68 is oriented toward the chain 16 so that an insert being conveyed by movement of a pusher 60 is directed into juxtaposition with the adhesive carrying signature, causing adherence of the insert with the moving signature.

Figure 3:
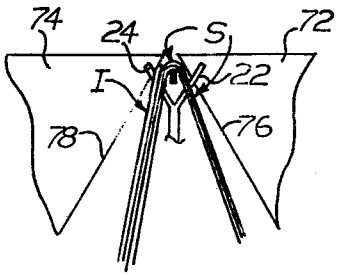
FIG. 3 is an enlarged sectional view of the system of FIG. 1, taken from the direction 3—3.

According to a specific embodiment of the invention means are provided for applying positive pressure to the juxtaposed signature and insert to promote firm adherence of the insert to the signature. As illustrated in FIGS. 1, 2 and 3 a pair of pressure rollers 72, 74 are disposed adjacent each side of the saddle 14. The rollers have tapered surfaces 76, 78 which conform to the general shape of the signatures being moved by the saddle conveyor. The roller axes are spring urged toward one another so that the roller surfaces 76, 78 exert a pressure force against juxtaposed signatures and inserts being directed therebetween (see particularly FIG. 3). The positions of the roller axes are adjustible with respect to one another to adjust the pressure against the signatures and inserts. As seen in FIG. 2 the pusher members 60 associated with the auxiliary conveyor normally pass underneath the rollers so that they serve to positively direct the inserts into the nip between the rollers. In addition, as seen in FIG. 1, the rollers include respective cut out portions 80, 82 which are moveable into the nip between the rollers in timed relation to the entry of the pusher pins 18 of the saddle conveyor so that the pusher pins 18 pass between the rollers without interfering with the pressure applying function of the rollers.

The signatures which have been conveyed through the pressure rollers are then further conveyed in the direction of the arrow 84 for further processing. This further processing may include collating additionaly signatures on the saddle conveyor (such as from a standard hopper D and associated saddle), or if the insert is applied to the last of the signatures (as illustrated in FIGS. 1 and 2) the signatures and insert may be directed directly to a trimmer and binder station 86 of conventional design at which the signatures are trimmed and their backbones secured to each other.

The system set forth above may also be modified so as to be extremely versatile in operation. For example, it is contemplated that the height of the track of the auxiliary conveyor is adjustible in order to accommodate varying sizes of inserts, or to vary the orientation of the inserts relative to the signatures. Likewise, the position of the adhesive applying nozzle 70 is adjustable to accommodate inserts of varying sizes or inserts which are set to be applied to different positions relative to the signatures. Moreover, the timing of the auxiliary conveyor may be designed so as to orient the inserts in varying lengthwise positions relative to the moving signatures.

It is further contemplated that sheet or signature detection sensors, of conventional nature, may be arranged to detect misfeeds of signatures or inserts. In the event of a misfeed the adhesive applying station would be controlled so as not to apply adhesive to the appropriate signature. Additionally, conventional means would be provided for diverting misfed signatures or inserts. All the foregoing functions would be controlled by application of known techniques which will be readily apparent to those of ordinary skill in the art.

With the foregoing disclosure in mind it is believed that various obvious modifications of the principles of this invention will become further apparent to those of ordinary skill in the art.

What is claimed is:

1. Collating apparatus comprising a saddle conveyor including means for supporting signatures in a generally inverted V orientation and for moving said signatures along a longitudinally extending path in said generally invertd V orientation with outer sheets of the signatures facing opposite sides of said longitudinally extending path, said saddle conveyor further including at least one moveable sheet engaging portion for engaging signatures and moving signatures in said generally inverted V orientation, a plurality of hoppers spaced along one side of said longitudinally extending path, means for moving said sheet engaging portion successively past each of said series of hoppers, a first one of said hoppers including means for supporting one or more signatures, means for removing a signature from said first hopper and for directing the signature into position for engagement with said sheet engaging portion of said saddle conveyor, a second one of said hoppers including means for supporting one or more inserts, an auxiliary conveyor having an insert moving portion movable substantially parallel with and in timed relation to said sheet engaging portion of said saddle conveyor, means for removing an insert from said second hopper and for directing the insert into position for engagement with said insert moving portion of said auxiliary conveyor, means for applying adhesive to an outwardly facing surface of said signature as said signature is in said inverted V orientation and is being moved by said sheet engaging portion of said saddle conveyor, said auxiliary conveyor including means for directing the insert which is engaged by said insert moving portion into juxtaposition with respect to an adhesive carrying portion of said signature as said signature is being moved by said sheet engaging portion of said saddle conveyor and after said signature has been moved past said adhesive applying means.

2. Apparatus as defined in claim 1, including means for applying pressure to said signature and said insert after they have been moved into juxtaposition with each other.

3. Apparatus as defined in claim 1, wherein said auxiliary conveyor is disposed adjacent the side of the longitudinally extending path which is opposite to the side on which the hoppers are disposed, said adhesive applying means being disposed downstream of said second one of said hoppers, said auxiliary conveyor including track means forming a guide path for said insert as said insert is moved by said insert moving portion of said auxiliary conveyor, said track means disposed to guide said insert into juxtaposition with said signature downstream of said adhesive applying means.

4. Collating apparatus comprising a main conveyor including at least one sheet receiving portion movable successively past first and second sheet feeding stations, said first sheet feeding station having means for supporting a stack of signatures, means for removing a signature from said first sheet feeding station and for directing said signature into position for engagement with said sheet receiving portion of said main conveyor, said second sheet feeding station having means for supporting a stack of inserts, an auxiliary conveyor having an insert engaging portion movable in timed relation to the movement of said sheet receiving portion of said main conveyor, said auxiliary conveyor comprising a track disposed in fixed relation to a portion of said main conveyor, means for removing an insert from said second sheet feeding station and for directing said insert into position for engagement with said insert engaging portion of said auxiliary conveyor including means for directing said insert into engagement with said track, said insert engaging portion comprising a pusher member movable with respect to said track to push said insert which has been directed into engagement with said track along a path defined by said track, means for applying adhesive to a part of said signature as it is being moved by said main conveyor, said track defining a path disposed to bring said insert into juxtaposition with said signature as said signature is being moved by said main conveyor and after adhesive has been applied to said signature.

5. Apparatus as defined in claim 4, including means for applying pressure to said signature and said insert after they have been brought into juxtaposition with each other.

6. Apparatus as defined in claim 5, wherein said means for applying pressure to said signature and said insert comprises a pair of pressure rollers, said main conveyor and said auxiliary conveyor being disposed to direct said juxtaposed signature and insert into a nip formed by said pair of pressure rollers.

7. Collating apparatus comprising a main conveyor including at least one sheet receiving portion movable successively past first and second sheet feeding stations, said first sheet feeding station having means for supporting a stack of signatures, a saddle disposed in fixed position with respect to said first sheet feeding station, means for removing a signature from said first sheet feeding station and for directing said signature into engagement with said saddle, said saddle defining means for supporting said signature in an inverted V orientation, said main conveyor comprising a main pusher, said main conveyor including means for moving said main pusher into engagement with said signature while said signature is supported on said saddle for removing said signature from said saddle, an auxiliary conveyor having an insert engaging portion movable in timed relation to the movement of said sheet receiving portion of said main conveyor, said auxiliary conveyor comprising a track, means for removing said insert from said second sheet feeding station and for directing said insert into position for engagement with said insert engaging portion of said auxiliary conveyor including means for directing said insert into engagement with said track, said insert engaging portion comprising an auxiliary pusher movable with respect to said track for engaging and moving said insert along a path defined by said track, an adhesive applying station including means for applying adhesive to a part of said signature as it is being moved by said main pusher of said main conveyor, said track defining a path which is disposed to guide said insert into juxtaposition with said signature while said signature is being moved by said main pusher and after said signature has been moved past said adhesive applying station.

8. Apparatus as defined in claim 7 wherein said main conveyor includes means for moving said main pusher along a longitudinally extending path for moving a signature along said longitudinally extending path in an inverted V orientation with outer sheets of the signature facing the opposite sides of said longitudinally extending path, said first and second sheet feeding stations being spaced along one side of said longitudinally extending path, said track being disposed along the opposite side of said longitudinally extending path.

* * * * *